US006317910B1

(12) United States Patent
Wilson

(10) Patent No.: US 6,317,910 B1
(45) Date of Patent: Nov. 20, 2001

(54) SUSPENDED BED CANOPY

(76) Inventor: Keith R. M. Wilson, 12 Invicta Road, London (GB), SE3 7HF ( * ) Notice: Subject to any disclaimer, the term of this patent is extended or adjusted under 35 U.S.C. 154(b) by 0 days.

(21) Appl. No.: 09/512,443

(22) Filed: Feb. 25, 2000

(51) Int. Cl.[7] ..... A47C 29/00

(52) U.S. Cl. ..... 5/658; 5/414; 135/90; 135/96

(58) Field of Search ..... 5/414, 658; 135/90, 135/96; 52/39

(56) References Cited

U.S. PATENT DOCUMENTS

| | | | |
|---|---|---|---|
| 77,207 | 4/1868 | Palmer . | |
| 87,589 | 3/1869 | Platt . | |
| D. 249,915 | 10/1978 | Vargas . | |
| 4,729,137 | 3/1988 | Denney | 5/414 |
| 4,785,837 | 11/1988 | Hansen et al. | 5/414 |
| 5,836,330 | 11/1998 | Franklin | 135/96 |

*Primary Examiner*—Alexander Grosz

(57) ABSTRACT

A suspended bed canopy for suspending a canopy over a bed without supports being attached to and extending from the bed. The suspended bed canopy includes a suspension assembly comprising a plate member and a frame. The plate member has a top side, a bottom side and a peripheral edge extending therebetween. The top side has a plurality of bores therein. The frame generally has a length and width greater than a length and width of the plate member. The frame has an inner surface and an outer surface. A plurality of hanging means is insertable in the bores and removably hangs the plate from the ceiling. A panel is removably coupled to the plate and the frame such that the panel secures the plate to the frame.

8 Claims, 3 Drawing Sheets

SUSPENDED BED CANOPY

BACKGROUND OF THE INVENTION

1. Field of the Invention

The present invention relates to canopies and more particularly pertains to a new suspended bed canopy for suspending a canopy over a bed without supports being attached to the bed.

2. Description of the Prior Art

The use of canopies is known in the prior art. More specifically, canopies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,836,330; 4,785,837; 4,729,137; U.S. Des. Pat. No. 249,915; U.S. Pat. Nos. 87,589; and 77,207.

While these devices fulfill their respective, particular objectives and requirements, the aforementioned patents do not disclose a new suspended bed canopy. The inventive device includes a suspension assembly comprising a plate member and a frame. The plate member has a top side, a bottom side and a peripheral edge extending therebetween. The top side has a plurality of bores therein. The frame generally has a length and width greater than a length and width of the plate member. The frame has an inner surface and an outer surface. A plurality of hanging means is insertable in the bores and removably hangs the plate from the ceiling. A panel is removably coupled to the plate and the frame such that the panel secures the plate to the frame.

In these respects, the suspended bed canopy according to the present invention substantially departs from the conventional concepts and designs of the prior art, and in so doing provides an apparatus primarily developed for the purpose of suspending a canopy over a bed without supports being attached to the bed.

SUMMARY OF THE INVENTION

In view of the foregoing disadvantages inherent in the known types of canopies now present in the prior art, the present invention provides a new suspended bed canopy construction wherein the same can be utilized for suspending a canopy over a bed without supports attached to the bed.

The general purpose of the present invention, which will be described subsequently in greater detail, is to provide a new suspended bed canopy apparatus and method which has many of the advantages of the canopies mentioned heretofore and many novel features that result in a new suspended bed canopy which is not anticipated, rendered obvious, suggested, or even implied by any of the prior art canopies, either alone or in any combination thereof.

To attain this, the present invention generally comprises a suspension assembly comprising a plate member and a frame. The plate member has a top side, a bottom side and a peripheral edge extending therebetween. The top side has a plurality of bores therein. The frame generally has a length and width greater than a length and width of the plate member. The frame has an inner surface and an outer surface. A plurality of hanging means is insertable in the bores and removably hangs the plate from the ceiling. A panel is removably coupled to the plate and the frame such that the panel secures the plate to the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new suspended bed canopy apparatus and method which has many of the advantages of the canopies mentioned heretofore and many novel features that result in a new suspended bed canopy which is not anticipated, rendered obvious, suggested, or even implied by any of the prior art canopies, either alone or in any combination thereof.

It is another object of the present invention to provide a new suspended bed canopy which may be easily and efficiently manufactured and marketed.

It is a further object of the present invention to provide a new suspended bed canopy which is of a durable and reliable construction.

An even further object of the present invention is to provide a new suspended bed canopy which is susceptible of a low cost of manufacture with regard to both materials and labor, and which accordingly is then susceptible of low prices of sale to the consuming public, thereby making such suspended bed canopy economically available to the buying public.

Still yet another object of the present invention is to provide a new suspended bed canopy which provides in the apparatuses and methods of the prior art some of the advantages thereof, while simultaneously overcoming some of the disadvantages normally associated therewith.

Still another object of the present invention is to provide a new suspended bed canopy for suspending a canopy over a bed without supports attached to the bed.

Yet another object of the present invention is to provide a new suspended bed canopy which includes a suspension assembly comprising a plate member and a frame. The plate member has a top side, a bottom side and a peripheral edge extending therebetween. The top side has a plurality of bores therein. The frame generally has a length and width greater than a length and width of the plate member. The frame has an inner surface and an outer surface. A plurality of hanging means is insertable in the bores and removably hangs the plate from the ceiling. A panel is removably coupled to the plate and the frame such that the panel secures the plate to the frame.

Still yet another object of the present invention is to provide a new suspended bed canopy that hangs from a ceiling allowing for more space in the room due to lack of canopy supports.

Even still another object of the present invention is to provide a new suspended bed canopy that may have additionally panels and drapes hung therefrom to enclose portions of the bed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
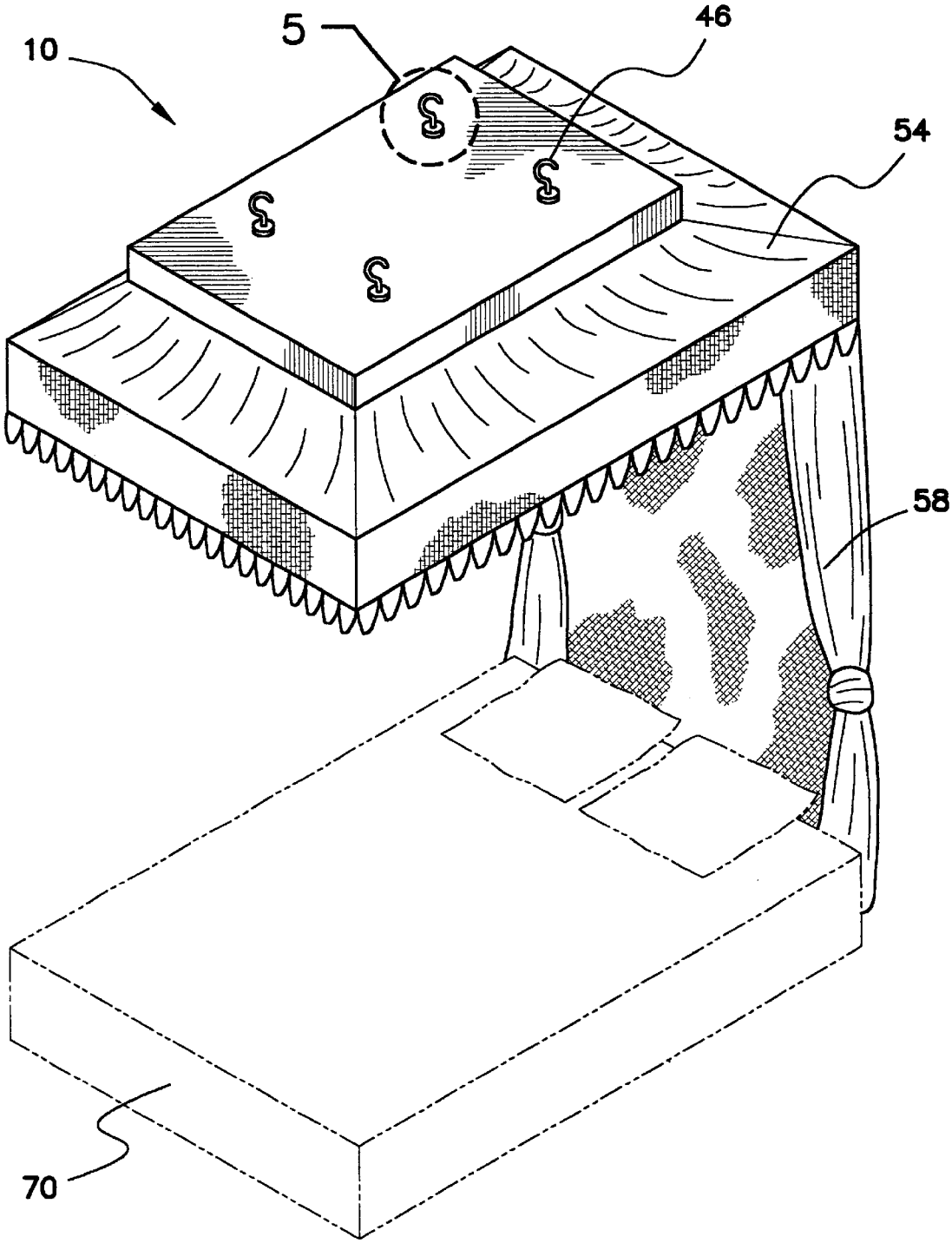
FIG. 1 is a schematic perspective view of a new suspended bed canopy according to the present invention.
Figure 2:
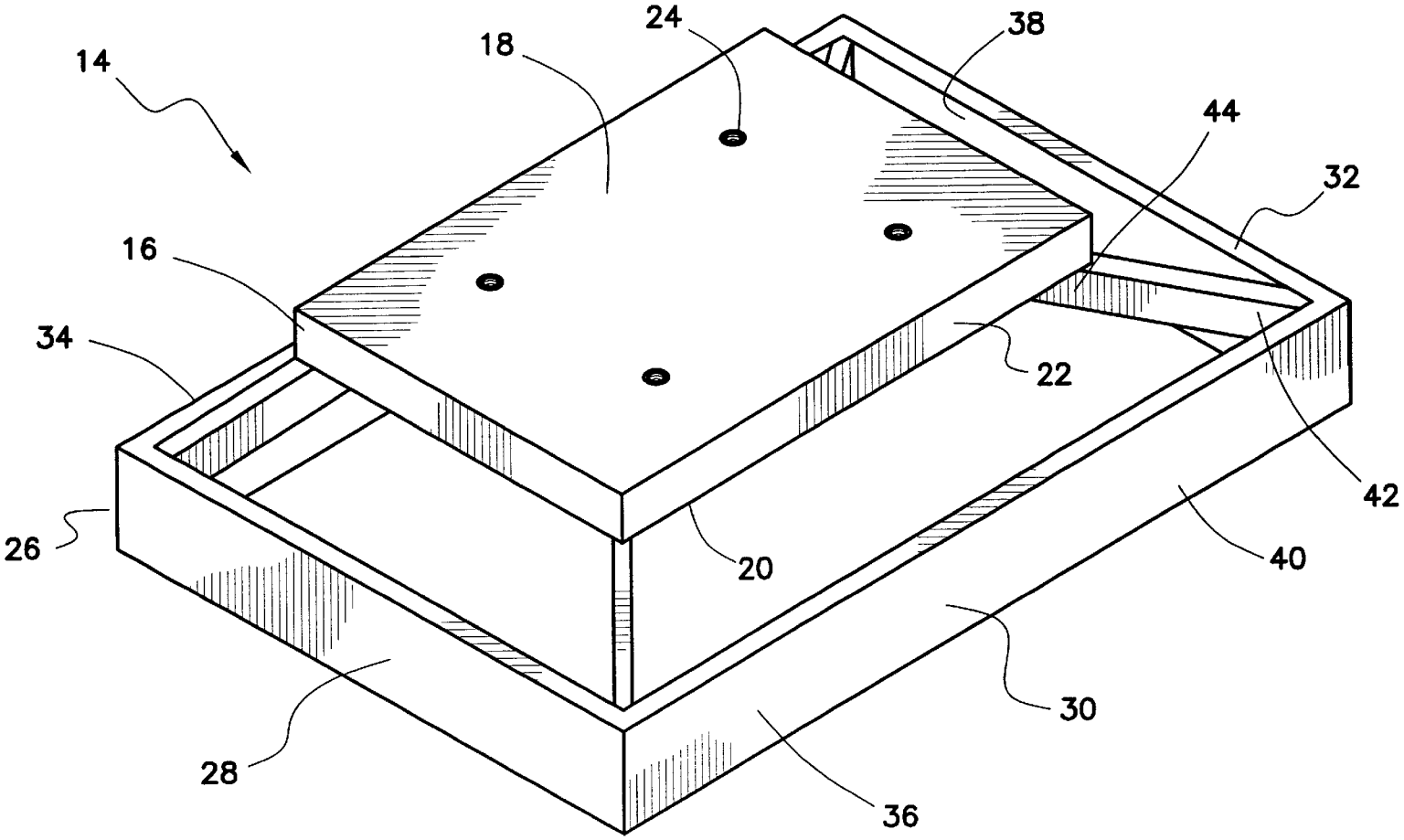
FIG. 2 is a schematic perspective view of the plate member and frame of the present invention.
Figure 3:
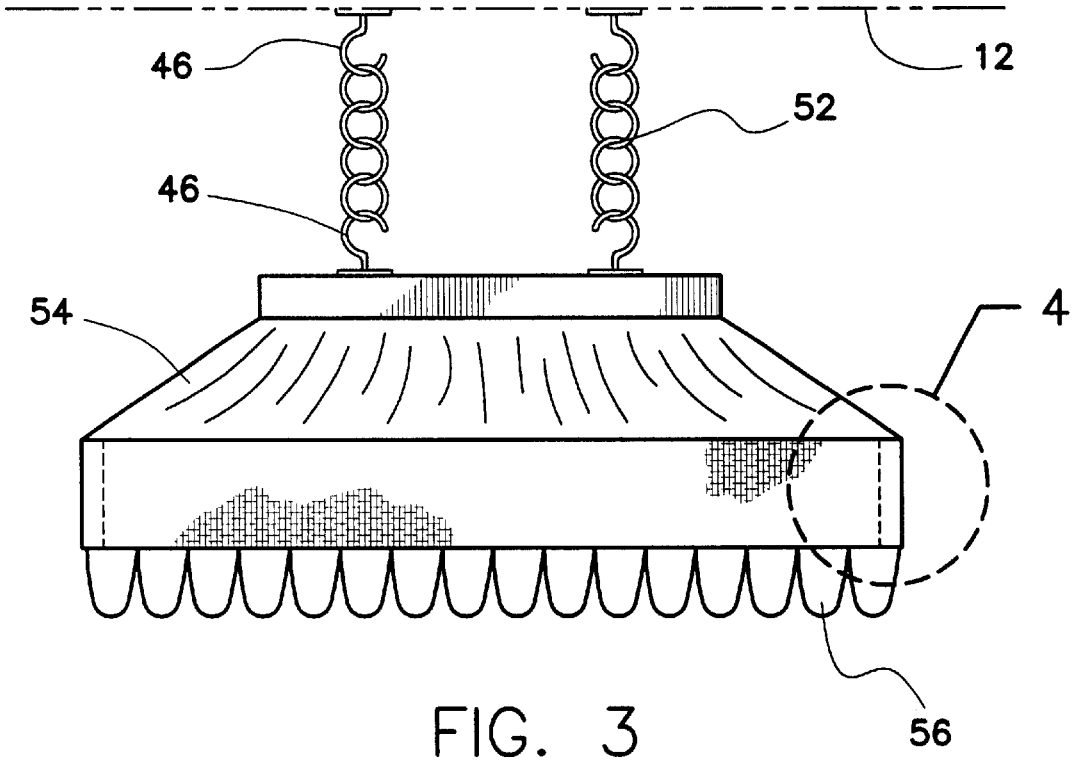
FIG. 3 is a schematic side view of the present invention.
Figure 4:
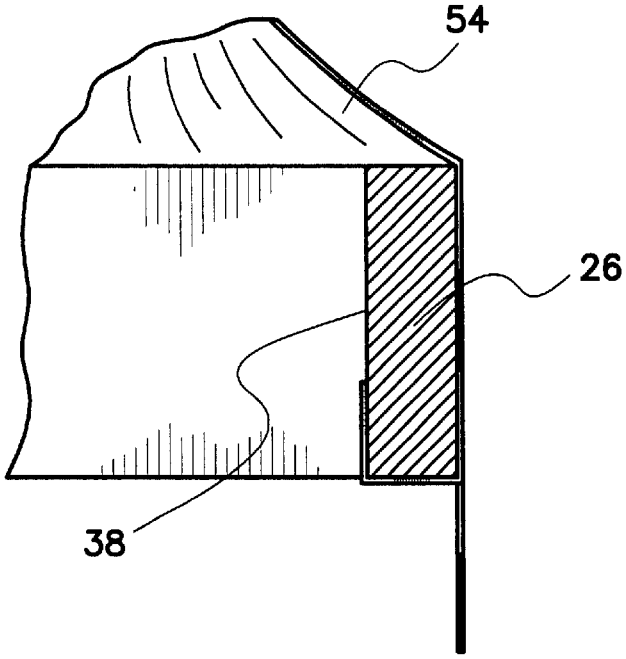
FIG. 4 is a schematic exploded view of the present invention.
Figure 5:
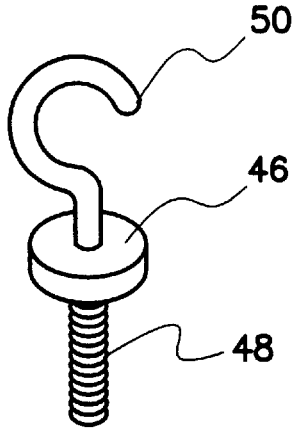
FIG. 5 is a schematic perspective view of the hanging means of the present invention.

With reference now to the drawings, and in particular to FIGS. 1 through 5 thereof, a new suspended bed canopy embodying the principles and concepts of the present invention and generally designated by the reference numeral 10 will be described.

As best illustrated in FIGS. 1 through 5, the suspended bed canopy 10 generally comprises a suspension assembly 14 for hanging from a ceiling wall 12.

The suspension assembly 14 includes a plate member 16. The plate member 16 has a top side 18, a bottom side 20 and a peripheral edge 22 extending therebetween. The top side 18 has a plurality of bores 24 therein. The top side 20 generally has a rectangular shape.

A frame 26, generally having a length and width greater than a length and width of the plate member, has a first wall 28, a second wall 30, a third wall 32 and a fourth wall 34. The frame 26 generally has a rectangular shape. The frame 26 has an outer surface 36 and an inner surface 38. The frame ideally has a length and width substantially equal to the length and width of the bed over which it is to be suspended.

Ideally, a plurality of fastening means 40 fixedly fastens the plate member 16 to the frame 26. Each of the fastening means 40 is an arm having a first 42 and second end 44. Each of the first ends 42 of the arms is fixedly coupled to the inner surface 38 of one of the corners of the frame 26. Each of the second ends 44 of the arms is fixedly coupled to the bottom side 20 of the plate member 16.

A plurality of hanging means 46 hang the plate member 16 from the ceiling 12. Each of the hanging means 46 has a distal portion 48 and a proximal portion 50. Each of the proximal portions 50 comprises a hook. Each of the distal portions 48 comprising a screw. Each of the screws is adapted to be removably inserted in the bores 24 in the top side 18 of the plate 16 and/or in the ceiling wall 12.

A plurality of securing means 52 releasably secures the hanging means 46 in the ceiling wall 12 to the hanging means 46 in the plate member. The securing means allow the user to hang the plate member 16 at varying distances from the ceiling wall 12. Each of the securing means 52 is a chain. Each of the chains has a plurality of rings therein for receiving one of the hooks 50 of the hanging means 46.

A panel 54 has an open central portion, not shown for reasons which will be readily understood. The opening has a shape and size substantially identical to the top side 18 of the plate member 16 so that the plate member 16 fits in the opening. The opening has a peripheral edge removably coupled to the bottom side 20 of the plate member such that the panel 54 extends over the arms 40 and the frame 26. The panel is coupled by conventional coupling means which may include a hook and loop fastening means, snaps and buttons. The panel 54 is draped over the outer surface 36 of the frame, 26 and is fixedly secured to the inner surface 38, of the frame 26. The panel 54 can be used to secure the plate member 16 to the frame 26 without the use of the fastening means 40, however the fastening means 40 insure greater stability. The panel 54 ideally comprises a cloth. The cloth is preferably cotton, wool, silk or a synthetic cloth.

Ideally, a plurality of swags, or ornamental draperies or curtains draped in a curve between two points, is removably coupled to the panel 54. The coupling means utilized for the swags are of a conventional type. Each of the swags may be positioned generally adjacent to a bottom edge of the frame 26. A long drape 58 or a plurality of them may be coupled to the panel 54 to hang down from the frame 26 and surround a bed 70.

A second embodiment, not shown, would use a projector mounted to the inner surface 36 of the frame. The projector could be adapted to project image stills on the interior of the canopy. The projector could be operationally coupled to a computer or television device for projecting images from such onto the interior of the canopy.

In use, the plate member 16 is secured to the ceiling wall 12 using the hanging means 46 and securing means 52. The panel 54 hangs down from the plate member 16 and surrounds the frame 26. Drapes 58 or other panels may be hung from the panel 54 to form a canopy around the bed 70. The user may change the panel, swags and drapes as seen fit such that the panel, swags and drapes match the interior of the room without the need for replacing the entire canopy.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A suspended bed canopy device for suspending from a ceiling wall, comprising:

a suspension assembly comprising:

a plate member having a top side, a bottom side and a peripheral edge extending therebetween, said top side having a plurality of bores therein;

a frame generally having a length and width greater than a length and width of said plate member, said frame having an inner surface and an outer surface;

a plurality of hanging means for removably hanging said plate member from said ceiling;

a panel being removably coupled to said plate member and said frame such that said panel secures said plate member to said frame.

2. The suspended bed device as in claim 1, wherein said frame comprises:

a first wall, a second wall, a third wall and a fourth wall, said frame generally having a rectangular shape, said frame having an inner surface and an outer surface, said panel being fixedly secured to said outer surface of said frame.

3. The suspended bed device as in claim 2, further comprising;

a plurality of fastening means for additionally fixedly fastening said plate member to said frame, each of said fastening members being an arm, each of said arms having a first and second end, each of said first ends of said arms being fixedly coupled to said inner surface of one of the corners of said frame, each of said second ends of said arms being fixedly coupled to said bottom side of said plate member.

4. The suspended bed device as in claim 3, wherein said panel comprises:

an open central portion, said opening having a shape and size substantially identical to said top side of said plate member, said opening having a peripheral edge being fixedly coupled to said bottom side of said plate member such that said panel extends over said arms and said frame, said panel being draped over said outer surface of said frame, said panel being removably secured to said inner surface of said frame, said panel comprising cloth.

5. The suspended bed device as in claim 1, wherein each of said hanging means comprises:

a distal portion and a proximal portion, each of said proximal portions comprising a hook, each of said distal portions comprising a screw, each of said screws being adapted to being removably inserted in said bores in said top side of said plate member and in said ceiling wall.

6. The suspended bed device as in claim 5, further comprising:

a plurality of securing means for releasably securing said hanging means in said ceiling to said hanging means in said plate member, each of said securing means being a chain, each of said chains having a plurality of rings therein for receiving one of said hooks of said hanging means.

7. A suspended bed canopy system, said system comprising:

a ceiling wall;

a suspension assembly, said suspension assembly comprising:

a plate member, said plate member having a top side, a bottom side and a peripheral edge extending therebetween, said top side having a plurality of bores therein, said top side generally having a rectangular shape;

a frame, said frame generally having a length and width greater than a length and width of said plate member, said frame having a first wall, a second wall, a third wall and a fourth wall, said frame generally having a rectangular shape, said frame having an inner surface and an outer surface;

a plurality of fastening means for fixedly fastening said plate member to said frame, each of said fastening members being an arm, each of said arms having a first and a second end, each of said first ends of said arms being fixedly coupled to said inner surface of one of the corners of said frame, each of said second ends of said arms being fixedly coupled to said bottom side of said plate member;

a plurality of hanging means for hanging said plate member from said ceiling, each of said hanging means having a distal portion and a proximal portion, each of said proximal portions comprising a hook, each of said distal portions comprising a screw, each of said screws being adapted to being removably inserted in said bores in said top side of said plate member and in said ceiling wall;

a plurality of securing means for releasably securing said hanging means in said ceiling to said hanging means in said plate member, each of said securing means being a chain, each of said chains having a plurality of rings therein for receiving one of said hooks of said hanging means; and a panel having an open central portion, said opening having a shape and size substantially identical to said top side of said plate member, said opening having a peripheral edge being removably coupled to said bottom side of said plate member such that said panel extends over said arms and said frame, said panel being draped over said outer surface of said frame, said panel being fixedly secured to said inner surface of said frame, said panel comprising cloth.

8. A suspended bed canopy system for use with a ceiling surface, comprising:

a suspension assembly, said suspension assembly comprising:

a plate member, said plate member having a top side, a bottom side and a peripheral edge extending therebetween, said top side having a plurality of bores therein;

a frame, said frame generally having a length and width greater than a length and width of said plate member, said frame having a first wall, a second wall, a third wall and a fourth wall, said frame having an inner surface and an outer surface;

a plurality of fastening means for fixedly fastening said plate member to said frame, each of said fastening members being an arm, each of said arms having a first and a second end, each of said first ends of said arms being fixedly coupled to said inner surface of one of the corners of said frame, each of said second ends of said arms being fixedly coupled to said bottom side of said plate member;

a plurality of hanging means for hanging said plate member from a ceiling, each of said hanging means having a distal portion and a proximal portion, each of said proximal portions comprising a hook, each of said distal portions comprising a screw, each of said screws being adapted to being removably inserted in said bores in said top side of said plate member and in a ceiling wall;

a plurality of securing means for releasably securing said hanging means in a ceiling to said hanging means in said plate member, each of said securing means being a chain, each of said chains having a plurality of rings therein for receiving one of said hooks of said hanging means; and a panel having an open central portion, said opening having a shape and size substantially identical to said top side of said plate member, said opening having a peripheral edge being removably coupled to said bottom side of said plate member such that said panel extends over said arms and said frame, said panel being draped over said outer surface of said frame, said panel being fixedly secured to said inner surface of said frame.

* * * * *